US006810205B2

(12) United States Patent
Kaplanis et al.

(10) Patent No.: US 6,810,205 B2
(45) Date of Patent: Oct. 26, 2004

(54) SPACE HEATER AND LIGHT SOURCE

(75) Inventors: Kostas Kaplanis, Urbana, OH (US); Charles M. Wagner, Urbana, OH (US)

(73) Assignee: The W. B. Marvin Manufacturing Company, Urbana, OH (US)

( * ) Notice: Subject to any disclaimer, the term of this patent is extended or adjusted under 35 U.S.C. 154(b) by 0 days.

(21) Appl. No.: 10/358,076

(22) Filed: Feb. 3, 2003

(65) Prior Publication Data

US 2004/0151484 A1 Aug. 5, 2004

(51) Int. Cl.[7] ..... H05B 3/00; F24D 13/00

(52) U.S. Cl. ..... 392/422; 392/376; 219/220; 362/92

(58) Field of Search ..... 392/422, 376, 392/360–369, 423, 430; 219/220; 362/92, 253

(56) References Cited

U.S. PATENT DOCUMENTS

| | | | | | |
|---|---|---|---|---|---|
| 893,994 | A | | 7/1908 | Green | |
| 1,579,513 | A | * | 4/1926 | Cameron | 392/408 |
| 1,660,802 | A | * | 2/1928 | Martin | 392/365 |
| 2,133,188 | A | * | 10/1938 | Conforti | 392/365 |
| 2,361,414 | A | * | 10/1944 | Ramsey | 362/240 |
| 2,372,832 | A | * | 4/1945 | Jepson | 392/360 |
| 2,445,250 | A | * | 7/1948 | Steingruber | 392/365 |
| 2,452,210 | A | | 10/1948 | Rogers | |
| 2,495,513 | A | | 1/1950 | Doyle | |
| 2,678,372 | A | | 5/1954 | Salton | |
| 2,870,319 | A | | 1/1959 | Ford | |
| 3,001,056 | A | * | 9/1961 | Spear | 392/360 |
| 3,005,081 | A | | 10/1961 | Kordes et al. | |
| 3,028,475 | A | * | 4/1962 | Nash | 392/360 |
| 3,059,090 | A | | 10/1962 | Waters | |
| 3,275,814 | A | * | 9/1966 | Meyer | 362/240 |
| 3,309,502 | A | | 3/1967 | Witherspoon, Jr. | |
| 3,322,946 | A | | 5/1967 | Cooper | |
| 3,785,271 | A | * | 1/1974 | Joy | 454/356 |
| 3,786,575 | A | | 1/1974 | Riblett | |
| 3,909,589 | A | | 9/1975 | Stone et al. | |
| 4,004,128 | A | | 1/1977 | Marchesi | |
| 4,263,500 | A | * | 4/1981 | Springer et al. | 392/428 |
| 4,681,024 | A | * | 7/1987 | Ivey | 219/220 |
| 4,760,243 | A | | 7/1988 | Tedioli | |
| 5,091,835 | A | * | 2/1992 | Malek et al. | 362/294 |
| 5,287,253 | A | | 2/1994 | Blorstad | |
| 5,381,509 | A | | 1/1995 | Mills | |
| 5,621,846 | A | | 4/1997 | Smith et al. | |
| 5,713,343 | A | | 2/1998 | Taylor et al. | |
| 5,922,227 | A | | 7/1999 | McMurtrie | |
| 5,984,490 | A | * | 11/1999 | Leen | 362/240 |
| 6,091,888 | A | | 7/2000 | Jane et al. | |
| 6,248,979 | B1 | | 6/2001 | Cafaro | |

OTHER PUBLICATIONS

Instruction Manual for Marvin 7530 "Quartz Halogen Heater" published by The W. B. Marvin Manufacturing Company, Urbana, Ohio, during 1995.

The Marvin 7530 Quartz Halogen Heater to which the Reference AR Instruction Manual is directed was marketed in the United States by applicants' assignee beginning during 1995.

Copending commonly assigned application No. 10/217,154 filed Aug. 12, 2002 titled "Space Heater with Area Light Source".

* cited by examiner

*Primary Examiner*—John A. Jeffery
(74) *Attorney, Agent, or Firm*—Roger S. Dybvig

(57) ABSTRACT

A radiant electric space heater is provided with a halogen light source which provides light to the same general area to which radiant electric energy is transmitted by the heating elements. The halogen light source includes a halogen light bulb located behind a grill that covers a window located at the front of the heater. A translucent lens is mounted on the rear of the grill in front of the halogen bulb.

10 Claims, 5 Drawing Sheets

FIG-1
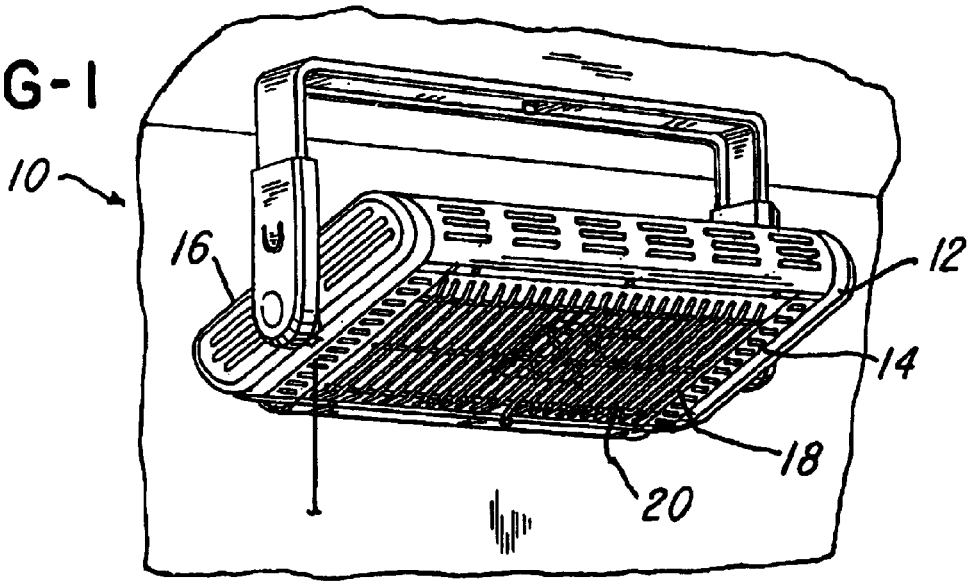
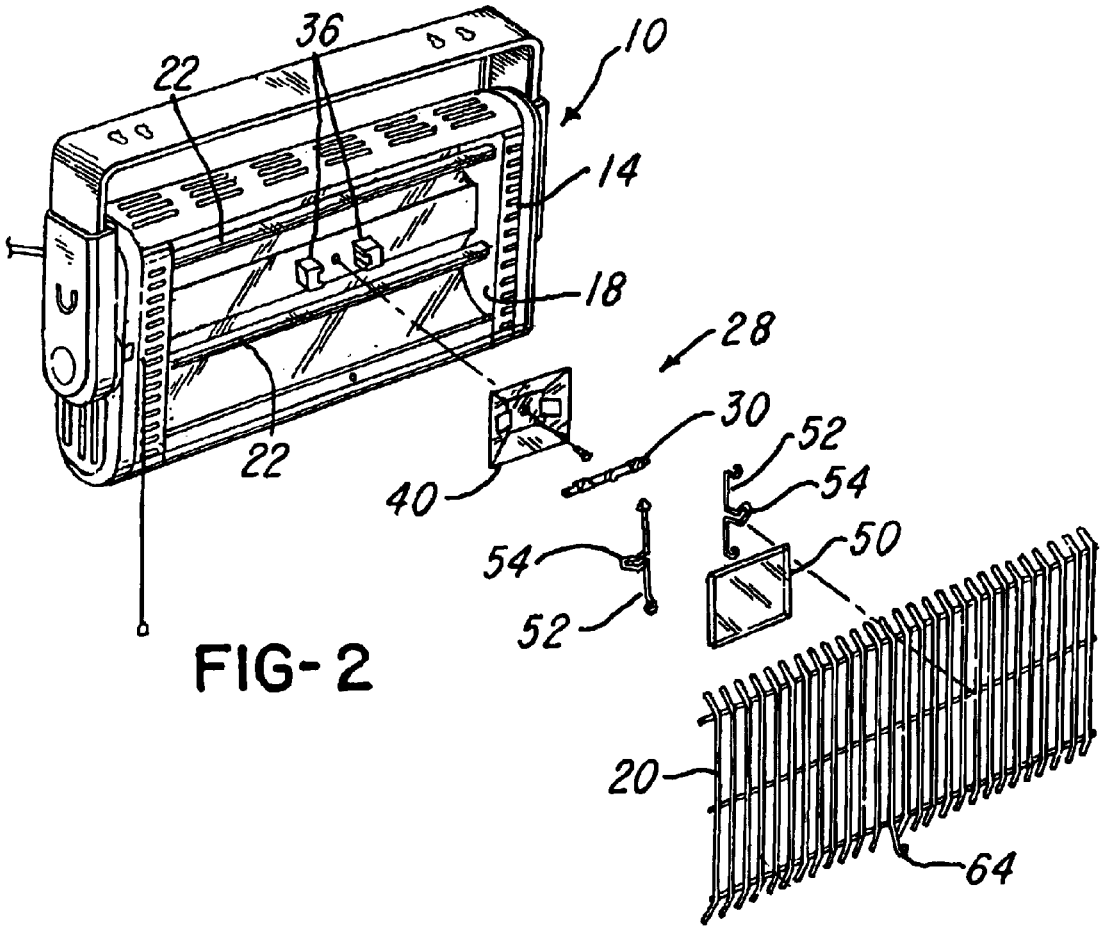
FIG-2

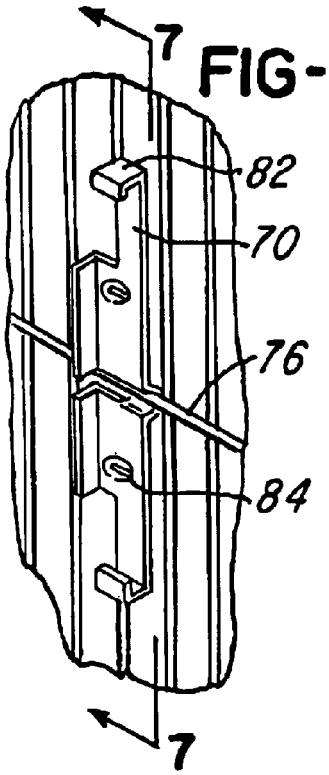
FIG-6
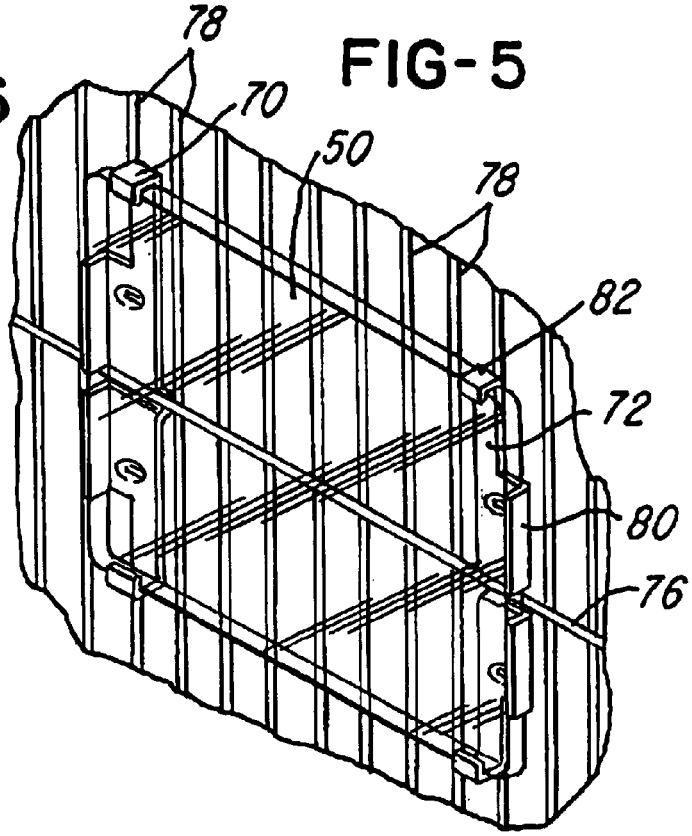
FIG-5
FIG-9
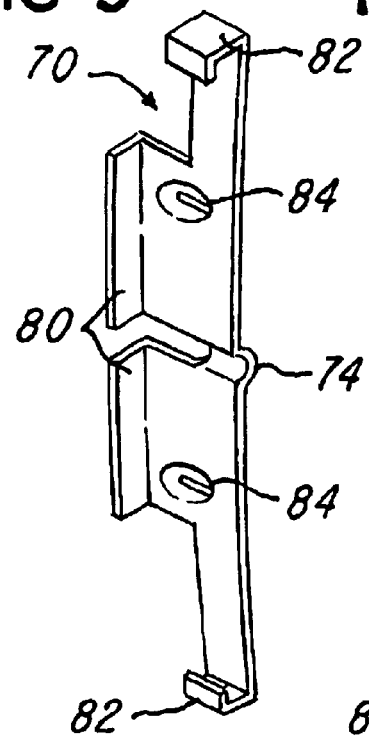
FIG-8
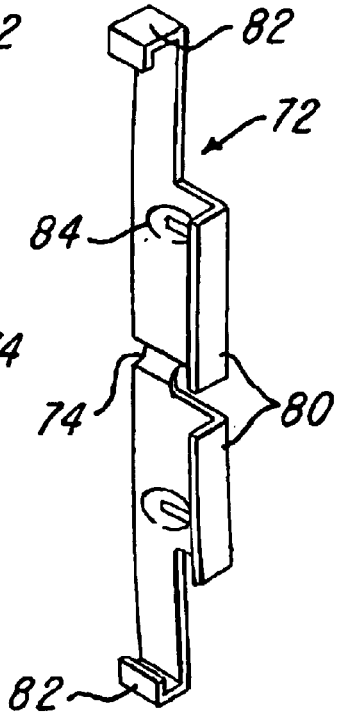
FIG-7
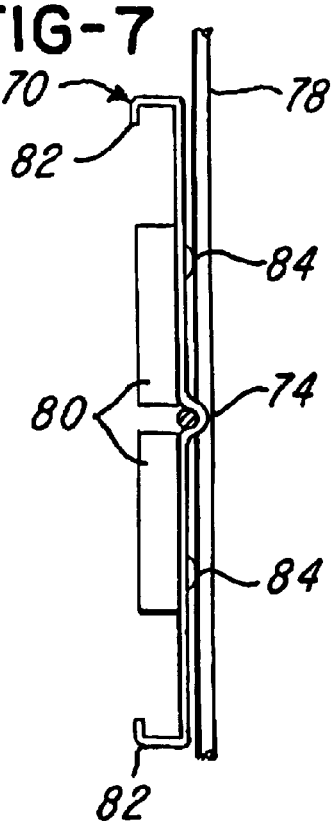

SPACE HEATER AND LIGHT SOURCE

INCORPORATION BY REFERENCE

The disclosures of U.S. Pat. Nos. 5,621,846, and 6,122,437, and 6,167,196 are hereby incorporated by reference herein.

FIELD OF THE INVENTION

This invention relates to electric space heaters with area light sources.

BACKGROUND OF THE INVENTION

Electric space heaters are in common use. Many such space heaters are portable. Some portable space heaters have mounting brackets by which they may be mounted on fixed surfaces, such as ceilings, or on movable supports, such as tripods. Space heaters are typically limited to the provision of heat to an area or to objects within an area. Some space heaters are primarily radiant heaters which heat objects within an area but contribute insignificant amounts of heat to the area by convection or conduction. Other space heaters are primarily convective heaters which have fans that blow heated air into an area. Both such types of space heaters are primarily useful only for providing heat to an area.

SUMMARY OF THE INVENTION

In accordance with this invention, a space heater has an area light source, which optionally can be a halogen light source, used to provide light to the same general area which is heated by the heater. The light source may be operable whether or not the heater is being operated to provide heat to the area.

The light source can be mounted in the heater and directed generally to the same area to which heat produced by the space heater is directed. With such enhancement, the heater will be useful whenever desired to add warmth to those in the area of the heater and will also be useful whenever desired to provide light to those in the area of the heater.

The invention may be used with either permanently mounted or portable space heaters. If a highly useful application of this invention, a workplace heater with a light source also includes a mounting assembly for mounting the heater housing on a wall, ceiling, or other support.

Further in accordance with invention, a light source is provided with a bulb which can be removed and replaced by an unskilled person following simple directions. The light source comprises a bulb socket that removably receives a light bulb, a light reflector mounted on the socket, and a light bulb removably mounted in the socket. A protective translucent plate or lens is mounted on the grill in front of the light bulb. If the light bulb stops working, it can be removed by moving the grill to an out-of-the-way position, carrying the protective translucent plate with it, to expose the bulb for removal and replacement.

Other objects and advantages will become apparent from the following description and the drawings.

BRIEF DESCRIPTION OF THE DRAWINGS

FIG. 1 is a perspective view of a workplace space heater provided with an area light source in accordance with this invention.

FIG. 2 is partly exploded perspective view of the heater of FIG. 1.

FIG. 5 is a fragmentary, perspective view similar to FIG. 4 but illustrating another embodiment of lens mounting clips.

FIG. 6 is a fragmentary perspective view of the grill and one of the mounting clips of FIG. 5 as viewed from behind the grill.

FIG. 7 is a fragmentary cross sectional view of the grill and the mounting clip of FIG. 6 as viewed along line 7—7 of FIG. 6.

FIG. 8 is a perspective view of the mounting clip of FIGS. 6 and 7.

FIG. 9 is a perspective view of the other mounting clip of FIG. 5.

DETAILED DESCRIPTION

Figure 3:
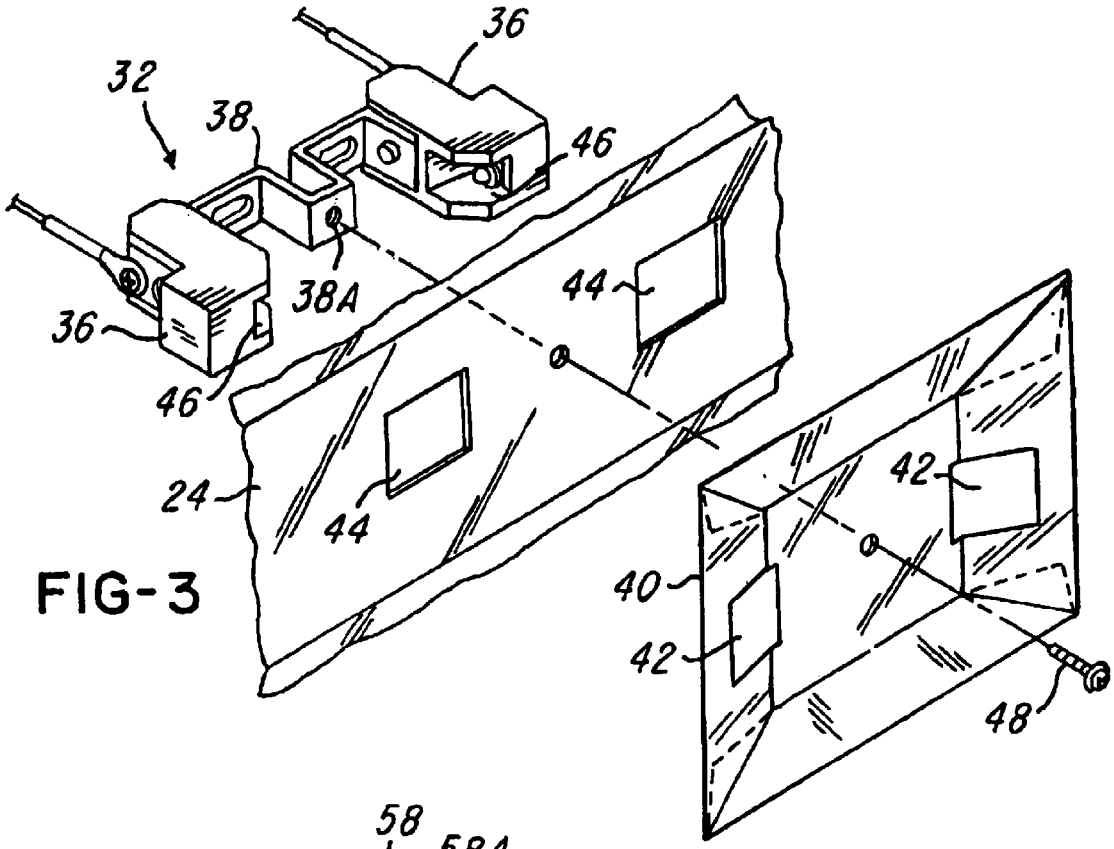
FIG. 3 is fragmentary, partly exploded, perspective view on a larger scale of parts of the heater of FIGS. 1 and 2, and shows particularly the mounting of the light socket and the bulb reflector on the heat reflector.

FIGS. 1 and 2 illustrate a space heater 10 of the type known as a workplace or workshop heater and is of the type illustrated in aforementioned U.S. Pat. Nos. 5,621,846 and 6,122,437.

The heater 10 has a housing 12 with a front wall 14 and a rear wall 16. The front wall 14 is open to provide a window 18 covered by a grill 20 for the passage of radiant heat there through. The radiant heat is generated by a pair of heating elements 22 mounted in front of a heat reflector 24. The construction of the parts of the heater 10 as thus far described can be essentially the same as the corresponding parts of the heater shown in U.S. Pat. No. 5,621,846.

Figure 4:
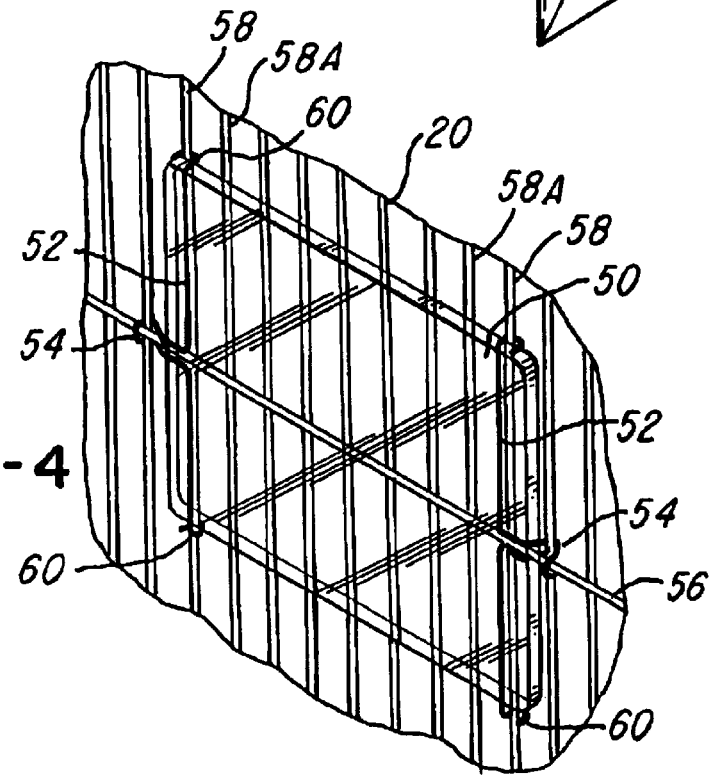
FIG. 4 is a fragmentary, perspective view, as viewed from the rear of the grill and on a larger scale than FIGS. 1 and 2, of the center portion of the grill of the heater of FIGS. 1 and 2 and shows particularly the mounting of the protective translucent lens on the grill by mounting clips.

With reference also to FIGS. 3 and 4, in accordance with the present invention, an area light source 28 is mounted on the reflector 24 in the housing 12 behind the grill 20. Although various light sources could be used in the practice of this invention, a light source 28 suitable for the practice of the present invention comprises a commercially-available halogen light bulb 30 removably mounted in a commercially-available bulb socket 32 having two terminal portions 36 connected to respective opposite ends of a mounting bracket 38. A bulb rated in the range between perhaps 50 to 200 or more watts could be used; a 100 watt bulb is considered satisfactory.

Light source 28 also includes a light reflector 40 mounted on the bulb socket 32 by a sliding connection between the two socket terminal portions 36 and respective openings 42 in the light reflector 40. The terminal portions 36 of the bulb socket 32 project forwardly through openings 44 in the heat reflector 24 so that the bulb-receiving parts 46 of the terminal portions 36 are located in front of the heat reflector 24. In addition, the light reflector 40, also located in front of the heat reflector 24, and the terminal mounting bracket 38 are screwed to one another and thereby held fixed to the heat reflector 24 by a mounting screw 48 threadedly engaged with a tapped opening 38A in the center of the terminal mounting bracket 38. The light reflector 40 is configured to have light reflective surface portions behind, above, below and beyond the ends of the halogen bulb 30. The marginal parts of the reflector 40 are angled so as to reflect light emitted from the bulb 30 into the same general area to which heat is radiated from the space heater 10.

Referring now to FIGS. 2 and 4, a protective translucent plate or lens 50 is connected behind the center of the grill 20 by a pair of vertically-extending, lens mounting clips 52, each made from a stiff metal wire or rod. Each clip 52 has a forwardly-extending U-shaped mid-section 54 that loops partly around a horizontal grill bar 56 and a vertical grill bar 58 spaced outwardly from the side margins of the lens 50. Each clip 52 also has upper and lower hook portions 60 that loop partly around other vertical grill bars 58A located in front of the lens 50. The legs of the U-shaped clip mid-sections 54 limit horizontal movements of the lens 50 and the upper and lower hook portions 60 extend respectively above and below the lens 50 to limit vertical movements of the lens 50. In addition, the lens mounting clips 52 are bowed slightly toward the lens 50, thereby pressing the lens 50 toward the rear of the grill 20 and holding in firmly in place on the rear of the grill 20.

The transparent plate or lens 50 may be made of a planar glass plate of any desired transparency. A satisfactory lens 50 for use with a heater having a three inch long halogen bulb could be 3/32 inch thick, about 4 and 5/8 inches wide and 3 and 3/8 inches high. The front surface of the lens 50 may desireably be pebbled. The lens 50 is positioned so as to cover the entire front of the light reflector 40 and to be engaged or nearly engaged with the forwardmost outer surfaces of the light reflector 50.

The grill 20 in the embodiment of FIGS. 1 through 4 is pivotally mounted on the sides of the heat reflector 24 and removably held in place on the front of the heater 10 by a screw that extends through a screw eye 64 in the same manner as the heater shown in the above-mentioned U.S. Pat. No. 5,621,846. This arrangement is advantageous for not only cleaning the area behind the grill 20, as described in U.S. Pat. No. 5,621,846, but also it enables the grill 20 to be moved to an out-of-the-way position to permit access to the halogen bulb 30 so that it may be removed and replaced.

FIGS. 5 through 9 show a second embodiment of clips, designated 70 and 72, respectively, made from sheet metal that can be used to mount the lens 50 on the grill 20. These have U-shaped mid-sections 74 that extend around a center horizontal grill wire 76 and confined between two vertical grill wires 78, side plates 80 extending along the sides of the lens 50 that cooperate to confine the lens 50 against horizontal movements, and upper and lower hooks 82 that extend, respectively, over the top and bottom surfaces of the lens 50 and that open downwardly and upwardly, respectively, to hold the lens 50 against vertical movements. The clips 70 and 72 have forwardly projecting protuberances 84 that bear against the grill wires 78 to create a firmly hold the lens 50 in place and thereby minimize or remove any noise that might otherwise be caused by vibrations of the lens 50.

Figure 10:
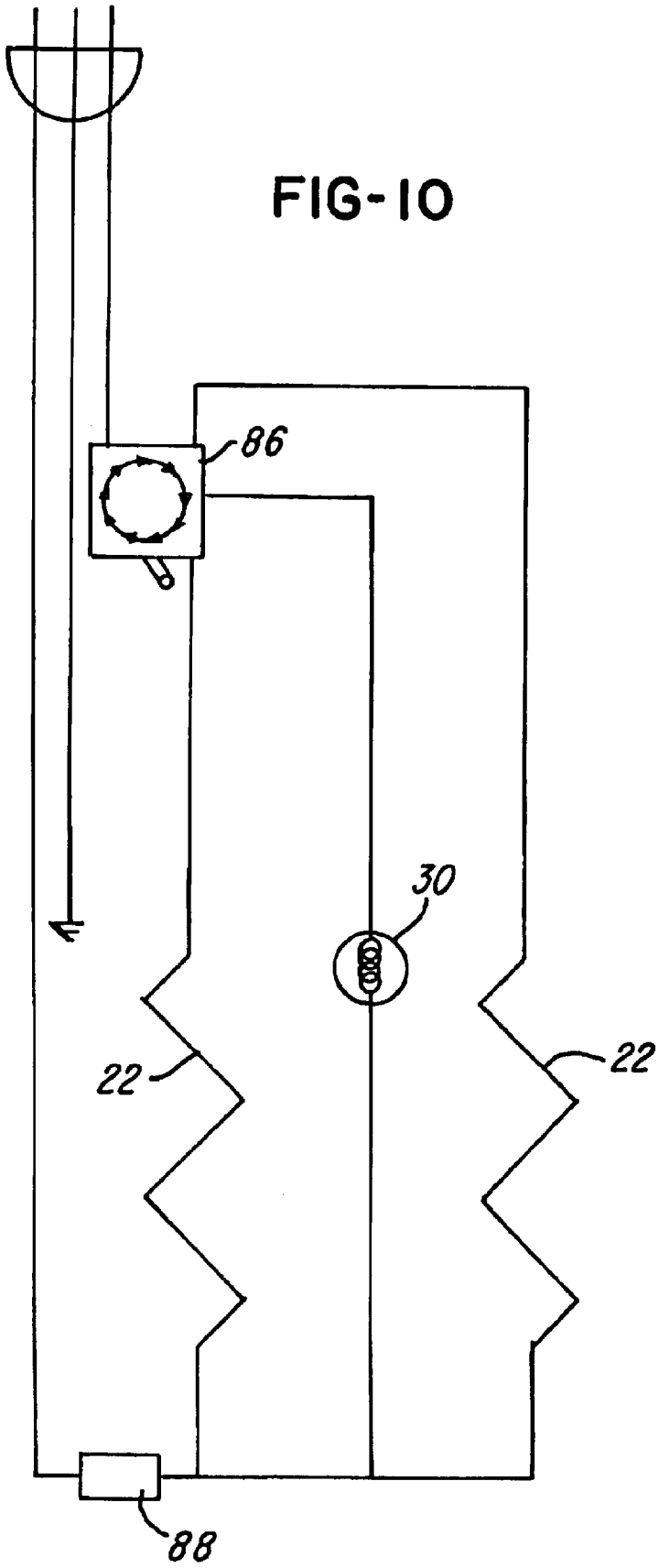
FIG. 10 is as schematic diagram of an electrical circuit which may be employed in the practice of this invention.

The electric circuit shown in FIG. 10 may be used with the embodiment of FIG. 1. The circuit includes the heating elements 22, the halogen light bulb 30, a rotary switch 86, and a thermal limiting device 88, such as a thermostat, for deenergizing the heater 10 in the event the temperature inside the housing 12 exceeds a set limit. In contrast to the rotary switch shown in U.S. Pat. No. 5,621,846, the rotary switch 86 is located inside the housing 12. The rotary switch 86 is not shown in other figures of the drawings because its construction can be conventional and it forms no part of the instant invention.

Although other switch positions are possible, the rotary switch could have four positions, as follows:

1. Off;
2. Light source only energized;
3. Light source and one heating element energized; and
4. Light source and both heating elements energized.

Optionally, for example, the rotary switch could have six positions, additionally including the following:

5. One heating element only energized; and
6. Both heating elements only energized.

As evident, other different switch arrangements could be employed.

Figure 11:
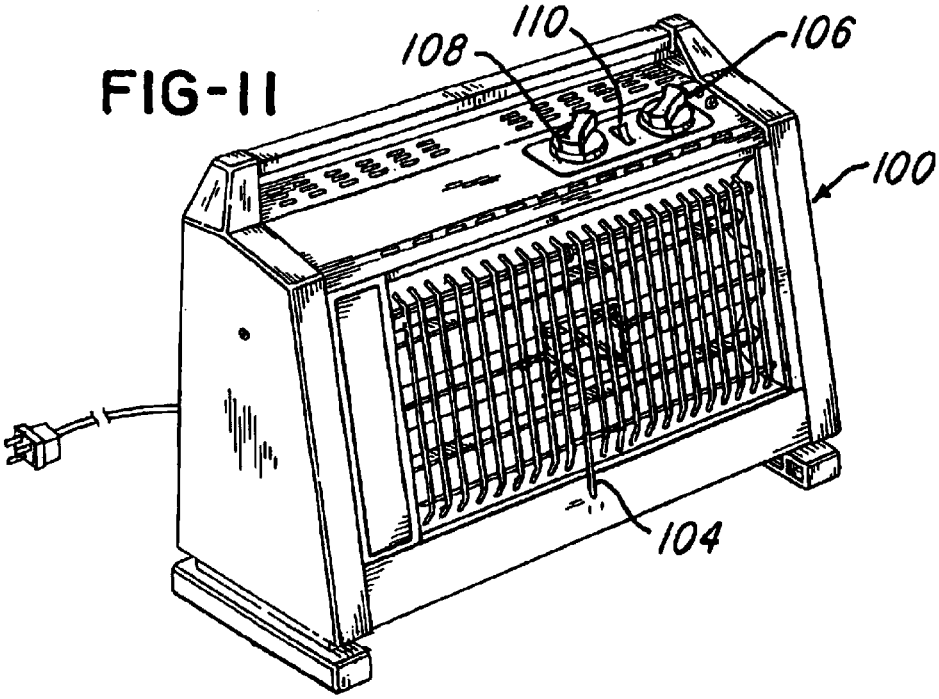
FIG. 11 is a perspective view of a portable, floor-supported space heater provided with an area light source in accordance with this invention.
Figure 12:
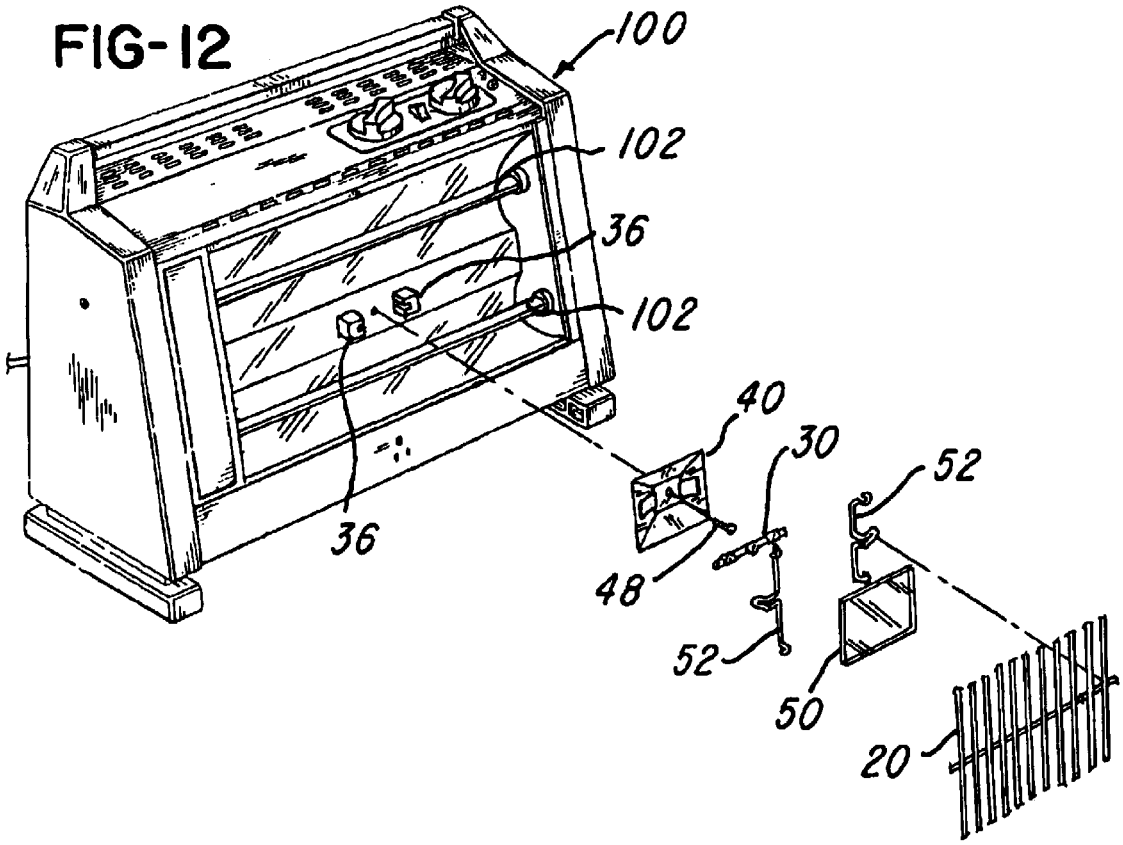
FIG. 12 is a partly exploded perspective view of the heater of FIG. 11.

FIGS. 11 and 12 show this invention applied to a horizontal style portable space heater, generally designated 100. In FIGS. 11 and 12, like elements of the invention are given like reference numbers of the reference numbers used in FIGS. 1 through 4. The lens mounting clips 52 of FIGS. 1 through 4 are illustrated in FIGS. 11 and 12 but, as evident, the sheet metal clips of FIGS. 5 through 9 could be used instead. In this case, the heating elements, designated 102, may optionally be removable in the manner similar to that illustrated in the above-mentioned U.S. Pat. No. 6,167,196, and a generally centrally located vertical grill wire 104 may have an extension which is locked to the heater housing and unlockable by use of a terminal plug.

The heater 100 of FIG. 11 may be provided with a first, heater and light control knob 106 which may provide the same switch positions as the rotary switch 86 of FIG. 10. A second, temperature control knob 108 controls a thermostatic switch (not shown) that controls the operation of the heater to provide heating ranges, such as low, medium and high heat levels. A separate rocker switch may be provided to enable a separate control of the halogen light.

It will be understood that within the purview of this invention, various changes may be made within the scope of the following claims.

We claim:

1. A space heater comprising:

a housing;

a window in the front of the housing;

a grill covering at least part of the window;

a heat reflector behind the grill;

at least one radiant heating element located between the heat reflector and the grill for transmitting radiant energy to a general area in front of the heater;

a light source removably supported within the housing behind the grill including a light bulb located between said grill and said heat reflector; and a translucent lens located between the bulb and the grill, said lens being affixed to said grill so that, by moving the grill to an out-of the-way position, the bulb is exposed so that it may be removed and replaced.

2. The space heater of claim 1 wherein said light source further comprises a light reflector for reflecting light emitted by said bulb forwardly through said grill.

3. The space heater of claim 2 wherein said reflector is shaped to reflect light from said bulb to provide light to the same general area to which heat is radiated by said space heater.

4. The space heater of claim 1 further comprising an electric circuit with an electric switch construction that enables energization of the at least one heating element and the light source separately or simultaneously.

5. The space heater of claim 1 wherein said light source is mounted on said heat reflector.

6. The space heater of claim 1 wherein said light bulb is a halogen bulb.

7. The space heater of claim 6 wherein said light source further comprises a light reflector for reflecting light emitted by said bulb forwardly through said grill.

8. The space heater of claim 7 wherein said reflector is shaped to reflect light from said bulb to provide light to the same general area to which heat is radiated by said space heater.

9. The space heater of claim 7 further comprising an electric circuit with an electric switch construction that enables energization of the at least one heating element and the light source separately or simultaneously.

10. The space heater of claim 7 wherein said light source is mounted on said heat reflector.

* * * * *